US006899846B2

(12) United States Patent
Woolf

(10) Patent No.: US 6,899,846 B2
(45) Date of Patent: May 31, 2005

(54) METHOD OF PRODUCING SURFACE DENSIFIED METAL ARTICLES

(75) Inventor: Richard Mark Woolf, Cincinnati, OH (US)

(73) Assignee: Sinterstahl Corp.-Powertrain, Dayton, OH (US)

( * ) Notice: Subject to any disclaimer, the term of this patent is extended or adjusted under 35 U.S.C. 154(b) by 14 days.

(21) Appl. No.: 10/341,838

(22) Filed: Jan. 14, 2003

(65) Prior Publication Data

US 2004/0136858 A1 Jul. 15, 2004

(51) Int. Cl.[7] ..... B22F 3/24
(52) U.S. Cl. ..... 419/28
(58) Field of Search ..... 419/28

(56) References Cited

U.S. PATENT DOCUMENTS

| | | | | | |
|---|---|---|---|---|---|
| 175,807 | A | | 4/1876 | Wistar | |
| 2,542,912 | A | | 2/1951 | Ensign | |
| 3,258,834 | A | | 7/1966 | Rork | |
| 3,553,809 | A | | 1/1971 | Yamada et al. | |
| 3,694,127 | A | | 9/1972 | Takahashi et al. | 425/352 |
| 3,851,512 | A | | 12/1974 | Zhuravlev et al. | 72/69 |
| 3,874,049 | A | * | 4/1975 | Ferguson | 419/28 |
| 3,951,561 | A | | 4/1976 | Speakman | 403/279 |
| 4,059,879 | A | | 11/1977 | Chmura et al. | 29/148.4 |
| 4,111,031 | A | | 9/1978 | Vennemeyer et al. | 72/359 |
| 4,128,933 | A | * | 12/1978 | Walrave | 419/28 |
| 4,398,407 | A | * | 8/1983 | DeFay, Jr. | 72/75 |
| 4,573,841 | A | | 3/1986 | Petkov et al. | 409/244 |
| 4,652,926 | A | | 3/1987 | Sasao et al. | 239/585 |
| 4,693,864 | A | | 9/1987 | Lloyd | 419/23 |
| 4,712,411 | A | | 12/1987 | Goodwin | 72/344 |
| 4,727,744 | A | | 3/1988 | Ferree | 72/466 |
| 4,771,627 | A | | 9/1988 | Speakman | 72/479 |
| 4,774,749 | A | * | 10/1988 | Furumura | 29/898.055 |
| 4,940,565 | A | | 7/1990 | Müller | 419/8 |
| 5,009,842 | A | | 4/1991 | Hendrickson et al. | 419/28 |
| 5,069,869 | A | | 12/1991 | Nicolas et al. | 419/28 |
| 5,233,738 | A | | 8/1993 | Finkbeiner et al. | 29/90.01 |
| 5,325,698 | A | | 7/1994 | Nagpal et al. | 72/267 |
| 5,363,714 | A | | 11/1994 | Hoguchi | 74/432 |
| 5,368,629 | A | | 11/1994 | Kondo et al. | 75/249 |
| 5,390,414 | A | | 2/1995 | Lisowsky | 29/893 |
| 5,403,544 | A | | 4/1995 | Adrian et al. | 419/36 |
| 5,409,662 | A | | 4/1995 | Hirai | 419/67 |
| 5,453,242 | A | | 9/1995 | Knoess | 419/27 |
| 5,503,506 | A | | 4/1996 | Yuan | 407/13 |
| 5,540,883 | A | | 7/1996 | Jones et al. | 419/28 |
| 5,613,180 | A | | 3/1997 | Kosco | 419/5 |
| 5,659,955 | A | | 8/1997 | Plamper | 29/893 |
| 5,711,187 | A | | 1/1998 | Cole et al. | 74/434 |
| 5,945,050 | A | * | 8/1999 | Jeong | 264/119 |
| 5,996,229 | A | | 12/1999 | Yang | 29/893 |
| 6,013,225 | A | * | 1/2000 | Cadle et al. | 419/29 |
| 6,017,489 | A | * | 1/2000 | Woolf et al. | 419/28 |
| 6,110,419 | A | * | 8/2000 | Buckley-Golder et al. | 419/28 |
| 6,142,004 | A | * | 11/2000 | Wier | 72/254 |
| 6,151,941 | A | * | 11/2000 | Woolf et al. | 72/102 |
| 6,168,754 | B1 | | 1/2001 | Woolf et al. | 419/28 |

* cited by examiner

*Primary Examiner*—Daniel Jenkins
(74) *Attorney, Agent, or Firm*—Metz Lewis LLC; Barry I. Friedman

(57) ABSTRACT

A method of producing powder metal articles includes compacting and sintering powder metal to produce a shaped powder metal preform having at least one exposed surface to be surface densified which extends parallel to an axis of the preform between a free end and a blind end adjacent a transverse portion of the preform. The blind surface is cold worked by forcing a shaped densifying tool axially along the surface in a direction from the free end toward the blind end, and then reversing the direction of the tool toward the free end to densify a layer of the material at the exposed surface. In addition to the blind surface, the article can include one or more additional surfaces that can be densified in the same manner in a simultaneous operation.

16 Claims, 8 Drawing Sheets

METHOD OF PRODUCING SURFACE DENSIFIED METAL ARTICLES

BACKGROUND OF THE INVENTION

1. Technical Field

This invention relates generally to the manufacture of powder metal articles, and more particularly to articles having a densified outer surface.

2. Related Art

It is known in the art to surface densify compacted and sintered powder metal articles in order to develop a densified layer of the powdered metal material on a surface of the article. Prior U.S. Pat. Nos. 6,017,489 and 6,168,754, which are commonly owned by the assignee of the present invention, disclose multi-stage densifying tools having a series of linearly spaced, progressively sized forming portions which, when forced across an outer or inner surface of the powder metal preform develop a densified layer of the material at the surface.

A particular challenge comes when the surface to be densified is a blind surface that is inaccessible from both ends, such as the outer surface of a hub extending from a radially larger base of a component or the inside wall of a closed or blocked end sleeve. Prior U.S. Pat. No. 5,540,883 teaches a process of densifying such blind surfaces by means of a roll forming operation in which a forming tool is forcibly rolled against the blind surface in the direction of its perimeter to yield a densified layer. However, depending upon the shape and accessibility of the particular surface, densification by roll forming may not be practically or economically feasible.

It is an object of the present invention to advance the art by providing a process which overcomes or greatly minimizes the foregoing limitations of the prior art processes.

SUMMARY OF THE INVENTION AND ADVANTAGES

A method of producing powder metal articles according to the invention comprises compacting and sintering powder metal to produce a shaped powder metal preform having at least one exposed surface to be surface densified extending parallel to an axis of the preform between a free end and a blind end adjacent a transverse portion of the preform. A shaped densifying tool is then forced axially along the exposed surface in a direction from the free end toward the blind end and then reversed in direction toward the free end to densify a layer of the material at the surface.

This method has the advantage of providing a simple, yet effective way of surface densifying blind and often difficult to access surfaces of powder metal workpieces.

The invention has the further advantage of being applicable to surface densifying both outer and inner facing blind surfaces of a powder metal workpiece and, in a preferred implementation of the method, enables the densification of multiple surfaces in a single simultaneous operation. For example, a powder metal workpiece having one or more inner blind surfaces and one or more outer blind surfaces can be surface densified in a single operation which saves time and cost in the manufacture of powder metal components having such features.

The invention has the further advantage of providing great flexibility to selecting the shape of blind surfaces to be densified by the process. Whereas roll form densification is limited by the shapes that can be rolled, with the axial densification, surfaces of complex shape that would not be suitable for roll form densification can nevertheless be densified according to the present invention in a very simple, cost effective manner.

The invention has the further advantage of providing greater control over the degree and uniformity of the surface densification as compared to roll forming.

THE DRAWINGS

These and other features and advantages of the present invention will become more readily appreciated when considered in connection with the following detailed description and appended drawings, wherein.

DETAILED DESCRIPTION

Figure 1:
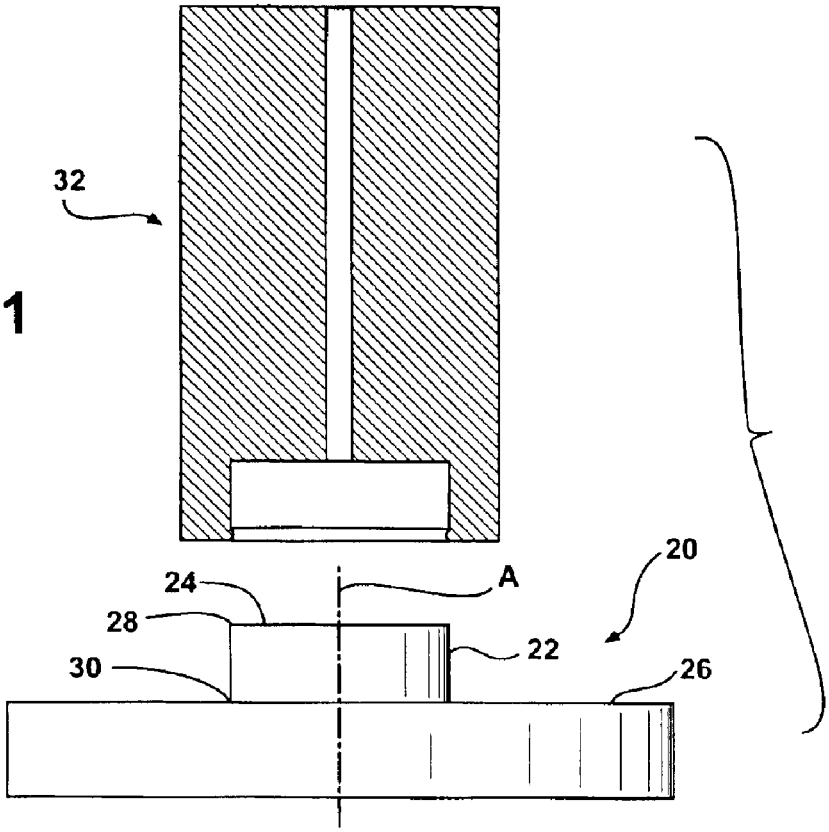
FIG. 1 is a schematic sectional view of a densifying tool shown in position to densify an outer blind surface of a preform workpiece.

Shown in the drawing figures are various embodiments of powder metal articles that have been compacted and sintered to near full theoretical density and to near-net shape to include at least one exposed, blind surface to be densified that extends parallel to an axis of the article and has a free end of the surface and a blind end. Some of the embodiments include one or more additional exposed surfaces that, according to the method of the invention, can be densified along with the at least one blind surface in a simultaneous densifying operation to yield a densified layer of the powder metal material on the surfaces that have been worked by the densifying tool to increase the density in the layer to essentially full density equal to or exceeding 99% of full theoretical density of the material. Details concerning each embodiment are described below, and it will be appreciated from the various embodiments that the method can be applied to any of a number of workpiece shapes with inner and/or outer surfaces to be densified and, having in common, at least one such surface that is blind in such manner as to block the passage of the workpiece completely past the forming tool.

Figure 2:
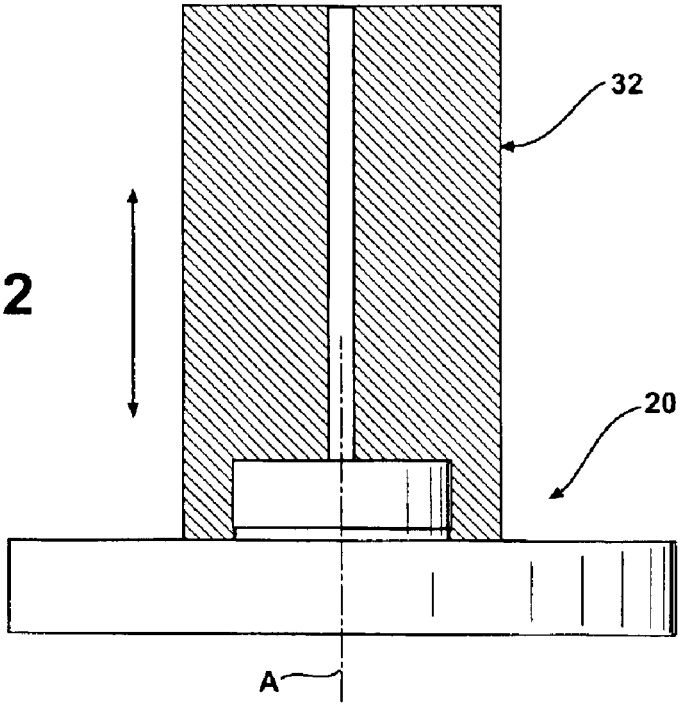
FIG. 2 is a view like FIG. 1 showing the tool acting on the workpiece.
Figure 3:
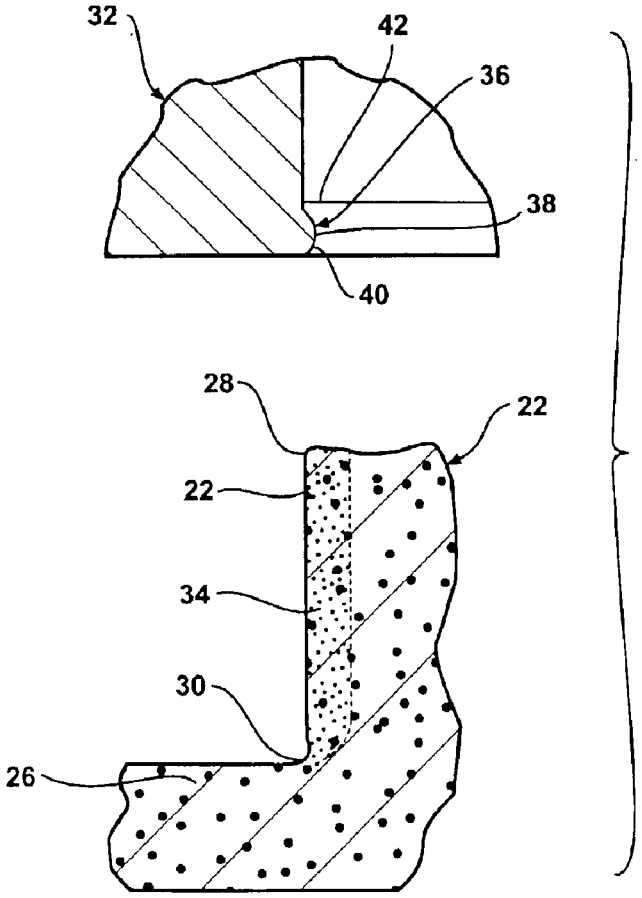
FIG. 3 is an enlarged fragmentary sectional view showing features of the tool and workpiece of FIGS. 1 and 2.

With particular reference to a first embodiment of the invention illustrated in FIGS. 1–3, the compacted and sintered powder metal preform article is shown at 20 having an exposed blind surface 22 formed on the outer surface of a hub portion 24 which extends from a radially larger transverse portion 26 of the preform 20 such that the surface 22 extends parallel to an axis A of the preform 20 between a free end 28 of the hub portion 24 and a blind end 30 adjacent the transverse portion 26. The end 30 is blind because the transverse portion 26 crosses the path of the blind surface 22 and blocks the extension of a forming tool past the blind end 30.

FIGS. 1–3 further show a densifying tool 32 that has shape closely complementing that of the near-net compacted and sintered shape of the blind surface 22, but sized such that when the tool 32 is passed over the blind surface 22, it further compacts and densifies the surface 22 to develop a densified layer 34 of the powder material at the blind surface 22 that is essentially fully dense (at or exceeding 99% of full theoretical density of the powder). The tool 32 includes an inside forming feature with a radially protruding forming surface 38 that engages the blind surface 22. The forming surface 38 is dimensioned slightly less than that of the blind surface 22, such that when the tool 32 is moved from the position shown in FIG. 1 to the position shown in FIG. 2 along the axis A, the protruding forming surface 38 of the tool 32 is caused to be forced axially along the blind surface 22 from the free end 28 toward the blind end 30. As the tool 32 moves along the blind surface 22, the forming surface 38 compresses and densifies the layer 34. This is illustrated best in FIG. 3, where the densified layer 22 is shown to have a greater localized density at and below the surface 22 than that of the bulk or core of the compact and sintered article 20.

As represented in FIG. 2, the surface 22 is densified by advancing the tool 32 axially over the surface 22 in one direction from the free end 28 toward the blind end 30, and then is reversed from the position of FIG. 2 back to the position of FIG. 1 to withdraw the tool 32 from the surface 22. As also shown in FIG. 2, the tool 32 can be advanced toward the blind end 30 to the point where the tool 32 encounters the transverse portion 26, after which the direction of the tool can be reversed and withdrawn from the surface 22.

According to a further aspect in the invention, one or more additional forming tools can be used to further densify the blind surface 22 and advanced in the same manner as the first tool 32 across the blind surface 22 to achieve further densification. Of course, the one or more subsequent densifying tools will be dimensioned to impart the desired successive compaction and densification of the blind surface 22 at each stage of densification. In the case of the outside blind surface 22 illustrated in FIGS. 1–3, the second and any subsequent tools will have a progressively smaller sized forming feature and forming surface than that of the first densifying tool 32.

As shown best in FIG. 3, the radially protruding forming surface 38 of the densifying tool 32 has a tapered leading edge 40 as well as a tapered trailing edge 42 with respect to the movement of the tool in the axial direction toward the blind end 30. The edges 40, 42 serve to guide and constrict the powder metal material at the surface 22 as the tool 32 is moved across the surface in the axial directions of movement so as to compact and densify the material of the layer 34 without removing any material from the surface 22. As the densifying tool is moved over the blind surface 22 toward the blind end 30, both plastic and elastic deformation of the surface 22 occurs to densify the layer 34. Accordingly, as the forming surface 38 passes over a portion of the blind surface 22 toward its movement to the blind end 30, the material on the trailing side of the forming surface 38 will recover its elastic deformation and thus will bulge radially outwardly beyond the inwardmost point of the forming surface 38. The tapered trailing edge 42 enables the forming tool to be withdrawn back over the blind surface 22 which, in the return movement, compresses the powder material at least elastically on the return stroke of the densifying tool 32.

Figure 4:
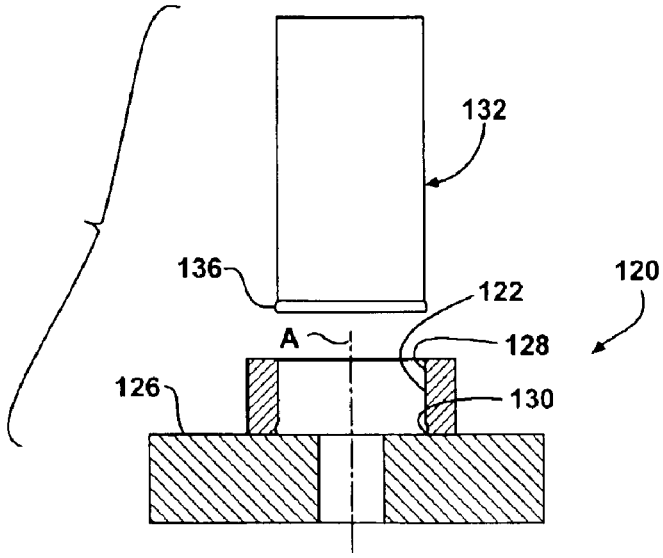
FIGS. 4–6 are like FIGS. 1, 2 and 3, respectively, but of a second embodiment.
Figure 5:
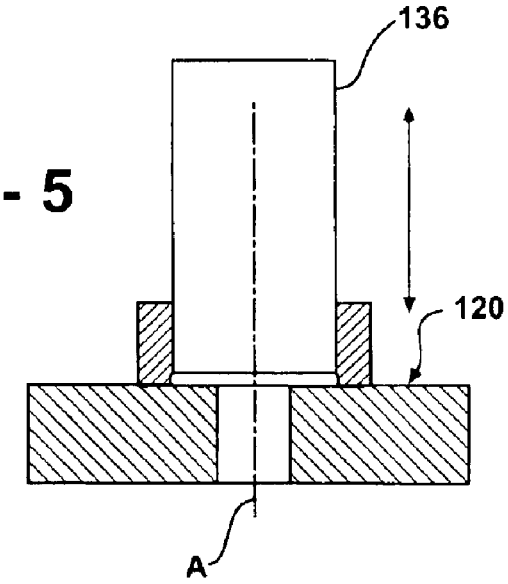
Figure 6:
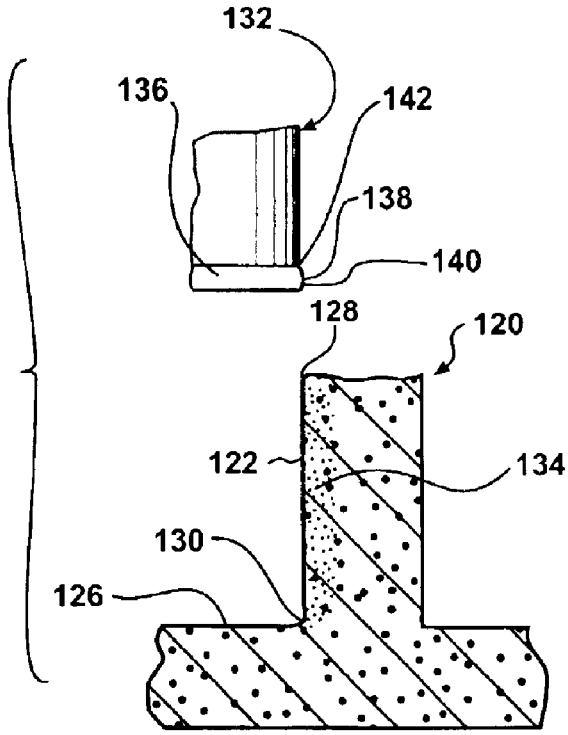

FIGS. 4–6 show a similar arrangement as that of FIGS. 1–3, except as applied to densifying an inside or inner blind surface of a powder metal article. As such, the same reference numerals as used in connection with describing the first embodiment of FIGS. 1–3, but are increased by 100. The principal difference is that the forming feature 136 of the densifying tool 132 projects radially outwardly of the tool 132 so as to densify the layer 134 of the radially inner blind surface 122 of the article 120. The remaining descriptions and principles described above are applicable to the second embodiment and thus are incorporated herein by reference.

Figure 7:
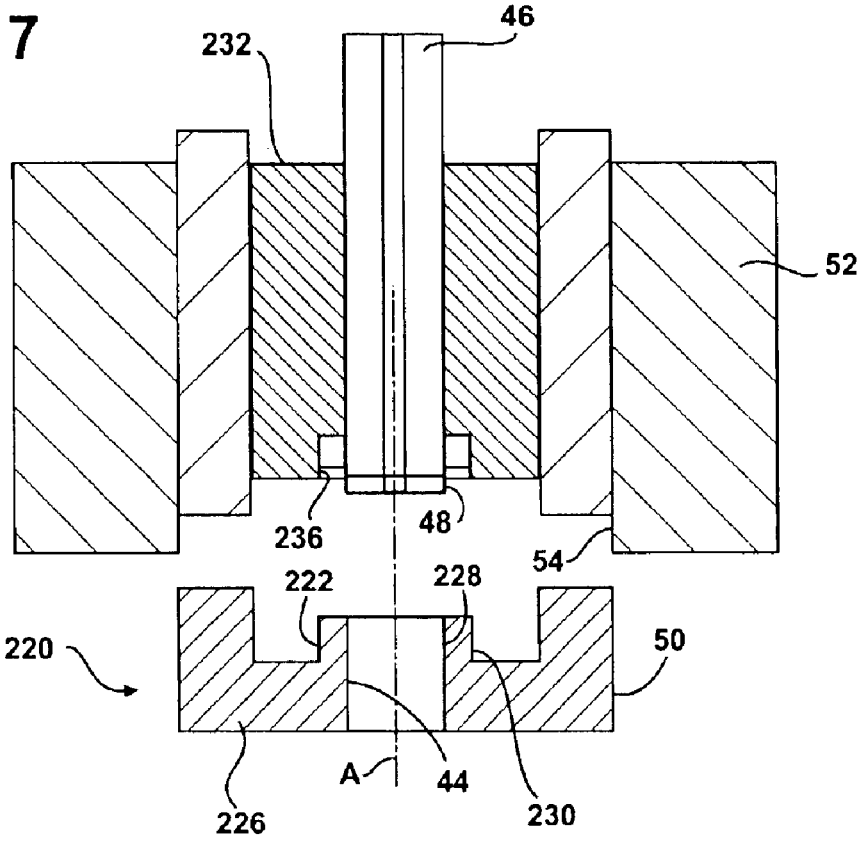
FIGS. 7 and 8 are like FIGS. 1 and 2, but of a third embodiment and including a movable portion of the densifying tool.
Figure 8:
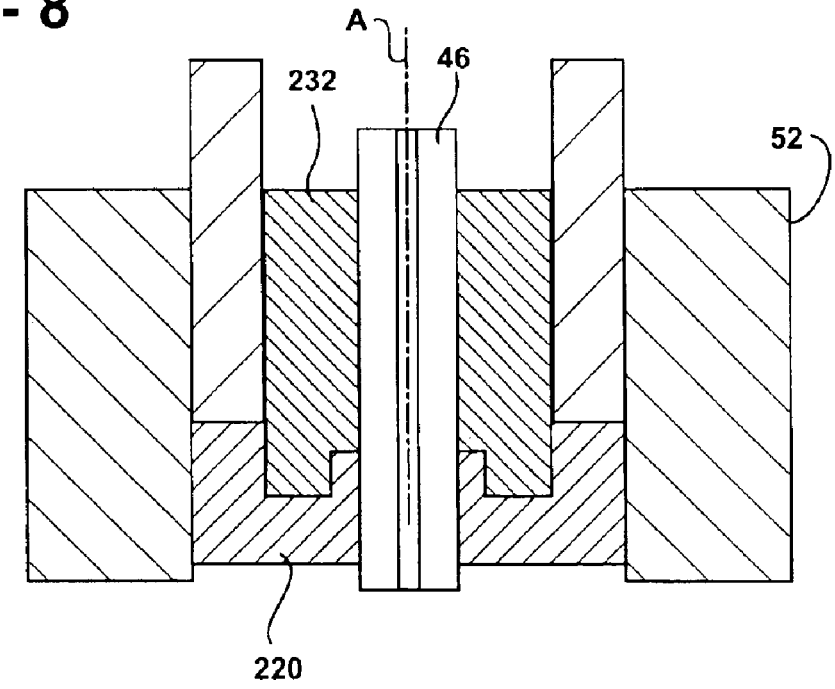

FIGS. 7 and 8 illustrate a third embodiment of the invention, wherein the same reference numerals are used to represent like features as that of the first embodiment of FIGS. 1–3, but are offset by 200. In this embodiment, the article 220 has an outer blind surface 222 to be densified in the manner described above and, in addition, includes a radially inwardly facing surface 44 that is also to be densified according to the method of the invention. In addition to the densifying tool 232 used to densify the outwardly facing blind surface 22, an inner densifying tool 46 is provided having a similarly shaped forming feature 48 as that described above in relation to the forming feature 136 of the second embodiment which is used to densify the inner surface 44 preferably simultaneously with the densification of the outer blind surface 234. Still further, the article 220 of the third embodiment has an additional outer surface 50 that is to be densified in the same manner described above in connection with the inner blind surface 222. For this purpose, a third densifying tool 52 is provided having an associated forming feature 54 which preferably corresponds to that of the forming feature 236 of the first densifying tool 232.

According to a further preferred aspect of the invention, the various densifying tools 232, 46 and 52 may be supported for relative axial movement with respect to one another in order to achieve densification of all surfaces 222, 44 and 50 in a single, simultaneous operation. As illustrated by a comparison of FIGS. 7 and 8, it will be seen that the inner 46 and outer 52 densifying tools move axially in relation to the first densifying tool 32 during the densifying stroke in both axial directions. This enables the relatively longer inner and outer surfaces 44, 50 to be densified simultaneously with the densification of the relatively shorter blind surface 222. The relative movement of the densifying tools can thus be adjusted accordingly to meet the requirements of a given application based on the relative links of the surfaces to be densified. In each case, a densified layer is formed at the densified surface like that of the densified layer 34 described above in connection with the first embodiment. Moreover, the various densifying tools can be formed with whatever shape corresponds to the shape of the surfaces to be densified (e.g., cylindrical, gear form, oval, rectangular, etc.) and thus can be different from one another if called for by a given application. Also, as described above in connection with the first embodiment, multiple sets of densifying tools can be employed, each having slightly larger or smaller sized forming features as required, to achieve multi-step progressive densification of the surface being treated.

Figure 9:
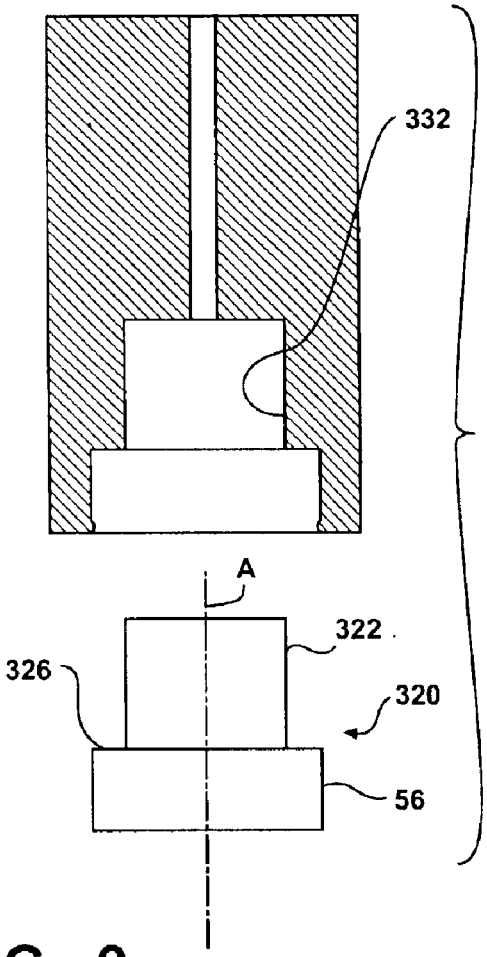
FIGS. 9–11 are like FIGS. 1–3, but of a fourth embodiment of the invention.
Figure 10:
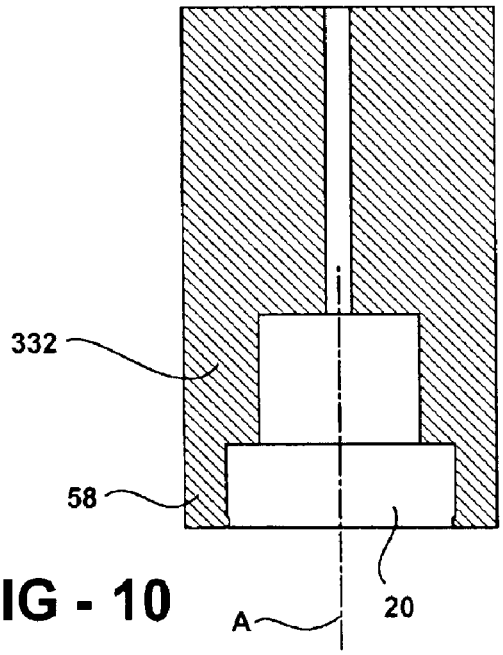
Figure 11:
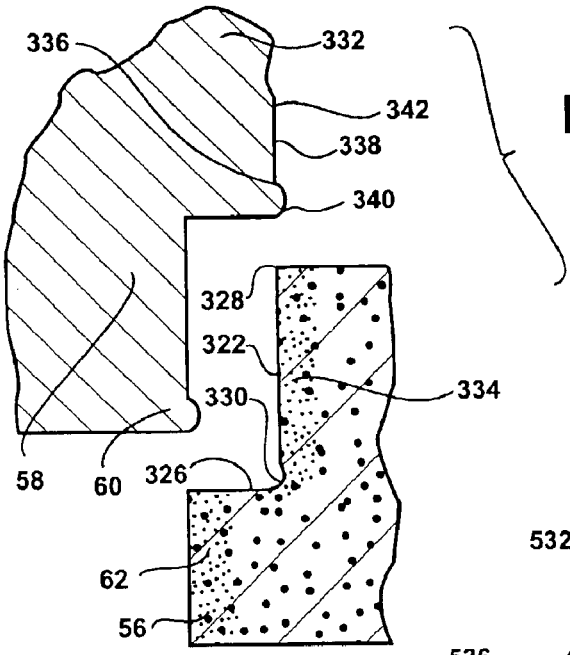

FIGS. 9–11 illustrate a fourth embodiment of the invention in which the same reference numerals are used to designate like features as that of the first embodiment, but are offset by 300. The powder metal article 320 includes, in addition to the outer blind surface 322, another outer surface 56 which is densified in the same manner using a second densifying tool having a similar forming feature 60 as that of the feature 36 of the first embodiment, and developing a corresponding densified layer 62 at the outer surface 56 in the same manner as that used to develop the layer 34 of the first embodiment. In this fourth embodiment, the tools 322 and 58 are formed as a single piece, although they could be separately movable as described in relation to the third embodiment of FIGS. 7–8.

Figure 12:
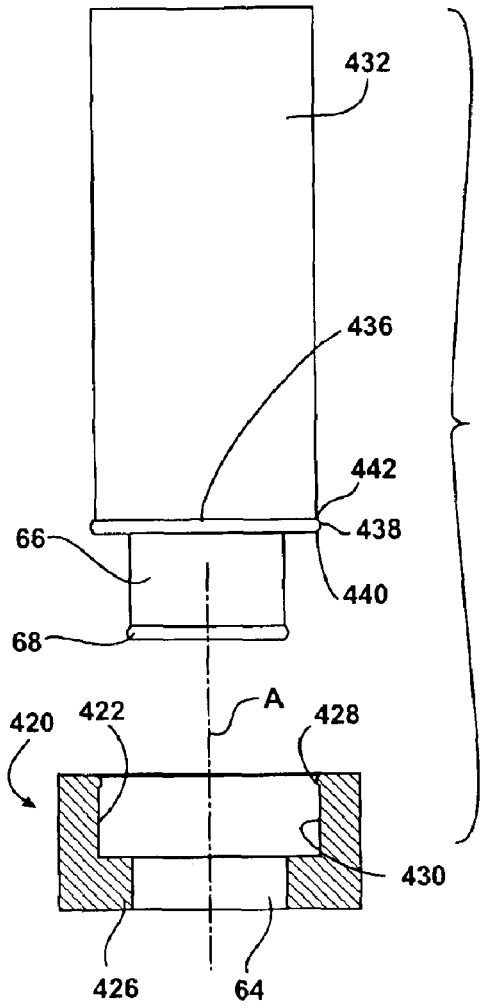
FIGS. 12 and 13 are like FIGS. 1 and 2, but of a fifth embodiment.
Figure 13:
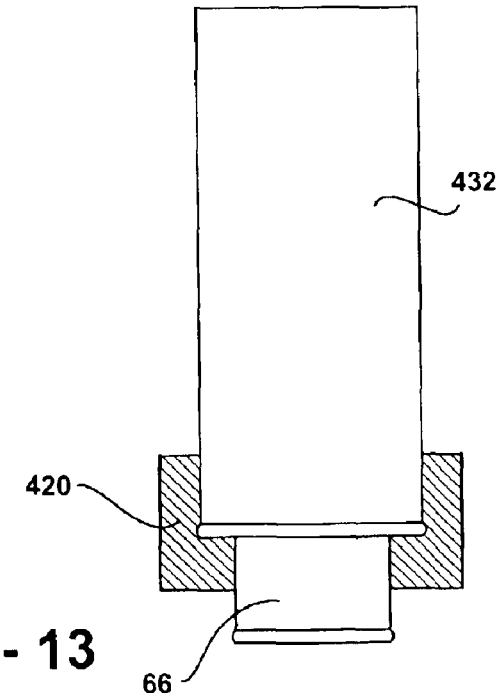

FIGS. 12 and 13 illustrate a fifth embodiment of the invention in which the same reference numerals are used to indicate like features to those of the first embodiment of FIGS. 1–3, but are offset by 400. In this case, the powder metal article 420 has an inner blind surface 422 that is densified by densifying tool 332, and a second inner surface 64 that is densified simultaneously in the same manner by a second densifying tool 66 having a forming feature 68 like that of forming feature 48 of the second embodiment. The tools 432 and 66 cooperate to densify the surfaces simultaneously and, as with previous embodiment, multiple sets of tools can be provided to achieve densification in multiple progressive steps if needed.

Figure 16:
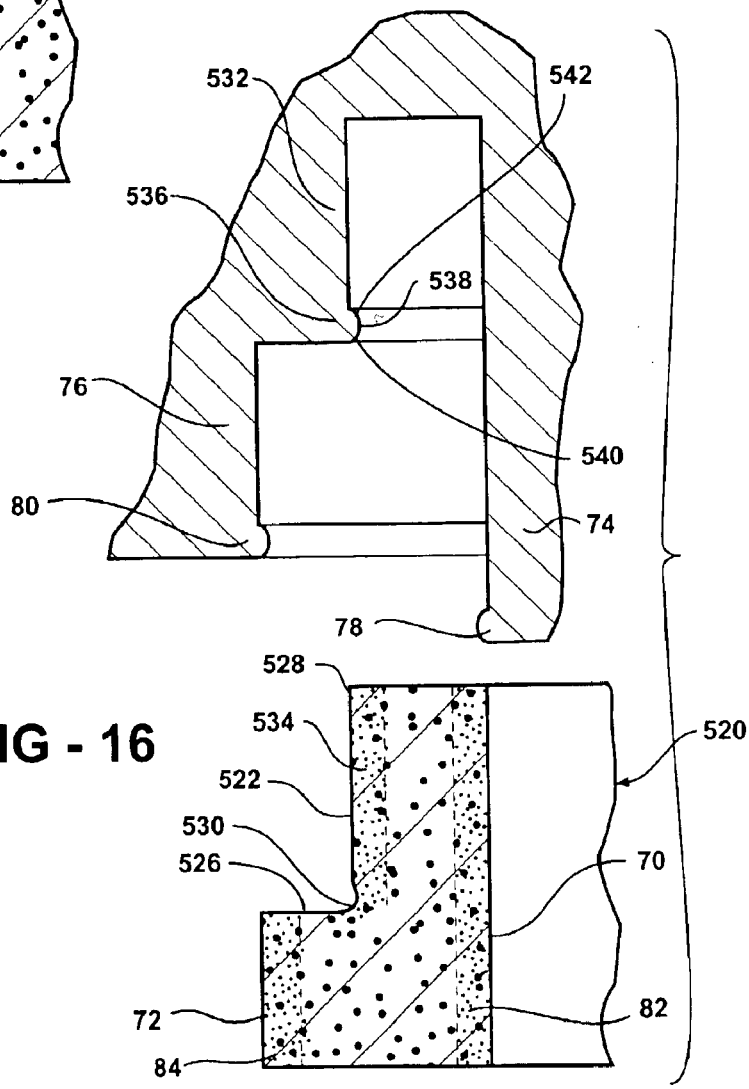
FIGS. 14–16 are like FIGS. 1–3 but of a sixth embodiment.
Figure 14:
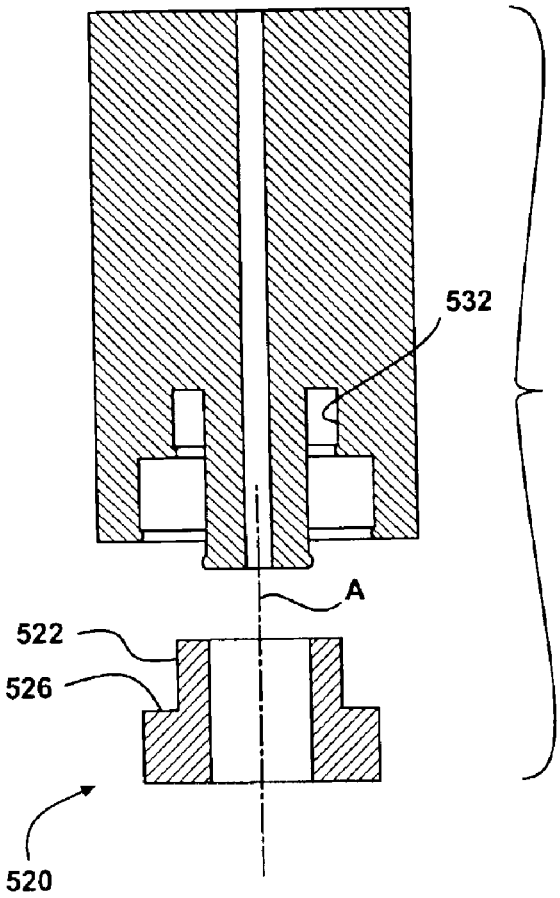
Figure 15:
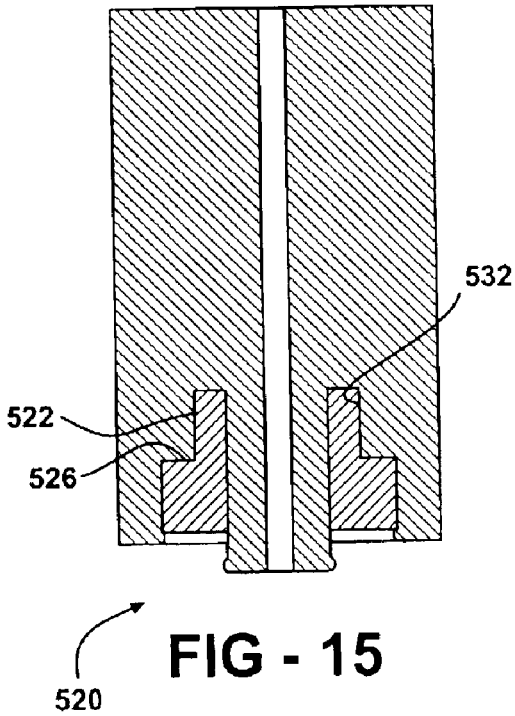

Finally, FIGS. 14–16 illustrate a sixth embodiment of the invention wherein like reference numerals are used to indicate like features to that of the first embodiment, but are offset by 500. The powder metal article 520 has, in addition to the blind surface 522, an inner surface 70 and an outer surface 72 that is densified simultaneously with the blind surface 522 in the same operation. The inner and outer surfaces 70, 72 are densified by corresponding densifying tools 78, 76 each having an associated forming feature 78, 80 like that of the feature 36 of the first embodiment. The tools 532, 74 and 76 may be formed as one unit, as illustrated, or may be provided as relatively movable portions of a densifying die as described above in connection with the third embodiment of FIGS. 7 and 8. The article 520 has densified layers 534, 82 and 84 on its blind surface 522 and inner and outer surfaces 70, 72, respectively, of the character described above in connection with the previous embodiments.

Accordingly, the embodiments illustrate various combinations of surfaces to be densified on a given powder metal preform article, all of which have in common, at least one such surface that is blind and processed by the method according to the invention.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A method of producing powder metal articles comprising:

compacting and sintering powder metal to produce a shaped powder metal preform having at least one exposed surface to be surface densified extending parallel to an axis of the preform between a free end and a blind end adjacent a transverse portion of the preform; and cold working the at least one exposed surface by forcing a shaped densifying tool axially along the at least one exposed surface in a direction from the free end toward the blind end to densify a layer of the material at the at least one exposed surface and then reversing the direction of the tool toward the free end.

2. The method of claim 1 wherein the at least one exposed surface comprises a radially outwardly facing surface.

3. The method of claim 1 wherein the at least one exposed surface comprises a radially inwardly facing surface.

4. The method of claim 1 wherein the preform includes at least one additional surface to be densified.

5. The method of claim 4 including forcing a densifying tool axially along the at least one additional surface to densify a layer of the material at the at least one additional surface.

6. The method of claim 5 wherein the surfaces are densified simultaneously.

7. The method of claim 6 wherein the surfaces comprise radially inwardly facing and radially outwardly facing surfaces of the preform.

8. The method of claim 6 wherein the surfaces comprise at least two separate radially inwardly facing surfaces of the preform.

9. The method of claim 6 wherein the surfaces comprise at least two separate radially outwardly facing surfaces.

10. The method of claim 6 including fixing the densifying tools against relative axial movement.

11. The method of claim 6 including supporting the densifying tools for axial movement relative to one another.

12. The method of claim 4 wherein the preform includes at least two additional surfaces to be densified and including forcing associated densifying tools axially along the at least two additional surfaces to densify a layer of the material at the at least two additional surfaces.

13. The method of claim 12 wherein the surfaces comprise radially inwardly and radially outwardly facing surfaces of the preform.

14. The method of claim 12 wherein the surfaces are densified simultaneously.

15. The method of claim 1 wherein the shaped densifying tool is formed with a radially protruding working surface having a tapered leading edge portion and a tapered trailing edge portion.

16. The method of claim 1 wherein the exposed surface is additionally cold worked by forcing at least a second subsequent forming tool along the exposed surface from the free end toward the blind end and then reversing the direction of the at least second tool toward the free end.

* * * * *

UNITED STATES PATENT AND TRADEMARK OFFICE

CERTIFICATE OF CORRECTION

PATENT NO. : 6,899,846 B2
APPLICATION NO. : 10/341838
DATED : May 31, 2005
INVENTOR(S) : Woolf et al.

It is certified that error appears in the above-identified patent and that said Letters Patent is hereby corrected as shown below:

Column 5, line 2, “322” should read -- 332 --.

Column 5, line 11, “332” should read -- 432 --.

Column 5, line 27, after the word “tools” delete “78” and insert -- 74 --.

Signed and Sealed this

Nineteenth Day of December, 2006

JON W. DUDAS
*Director of the United States Patent and Trademark Office*